US009557050B2

(12) United States Patent
Vandervort et al.

(10) Patent No.: US 9,557,050 B2
(45) Date of Patent: Jan. 31, 2017

(54) FUEL NOZZLE AND ASSEMBLY AND GAS TURBINE COMPRISING THE SAME

(75) Inventors: Christian Lee Vandervort, Voorheesville, NY (US); Joel Meier Haynes, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1625 days.

(21) Appl. No.: 12/847,688

(22) Filed: Jul. 30, 2010

(65) Prior Publication Data

US 2012/0023952 A1 Feb. 2, 2012

(51) Int. Cl.

| | |
|---|---|
| ***F02C 3/00*** | (2006.01) |
| ***F23C 6/04*** | (2006.01) |
| ***F23D 11/38*** | (2006.01) |
| ***F23D 14/48*** | (2006.01) |
| ***F23R 3/04*** | (2006.01) |
| ***F23R 3/14*** | (2006.01) |
| ***F23R 3/28*** | (2006.01) |

(52) U.S. Cl.

CPC ..... *F23C 6/045* (2013.01); *F23D 11/38* (2013.01); *F23D 14/48* (2013.01); *F23R 3/04* (2013.01); *F23R 3/14* (2013.01); *F23R 3/28* (2013.01)

(58) Field of Classification Search

CPC ..... F23C 6/045; F23D 14/48; F23R 3/14; F23R 3/26; F23R 3/343; F23R 3/04

USPC ..... 60/776, 740, 741–748, 39.281, 39.37,60/39.34, 39.35, 733, 738, 739; 239/127.1, 239/265.11

See application file for complete search history.

(56) References Cited

U.S. PATENT DOCUMENTS

| | | | |
|---|---|---|---|
| 4,171,612 | A | 10/1979 | Zwick |
| 4,265,085 | A | 5/1981 | Fox et al. |
| 4,720,970 | A | 1/1988 | Hudson et al. |
| 5,259,184 | A | 11/1993 | Borkowicz et al. |
| 5,491,970 | A | 2/1996 | Davis, Jr. et al. |
| 5,551,228 | A | 9/1996 | Mick et al. |
| 5,722,230 | A | 3/1998 | Cohen et al. |
| 5,729,968 | A | 3/1998 | Cohen et al. |
| 5,884,483 | A | 3/1999 | Munro |
| 5,924,275 | A | 7/1999 | Cohen et al. |
| 5,943,866 | A | 8/1999 | Lovett et al. |
| 5,974,781 | A | 11/1999 | Correa et al. |
| 6,164,055 | A | 12/2000 | Lovett et al. |

(Continued)

FOREIGN PATENT DOCUMENTS

| | | | |
|---|---|---|---|
| CN | 1763434 | A | 4/2006 |
| JP | 08074604 | A | 3/1996 |
| WO | 2009022449 | A1 | 2/2009 |

OTHER PUBLICATIONS

Philip G. Hill and Carl R. Peterson, Mechanics and Thermodynamics of Propulsion, Addison-Wesley, third printing Nov. 1970, p. 217.*

(Continued)

*Primary Examiner* — Ching Chang

(74) *Attorney, Agent, or Firm* — Pabitra K. Chakrabarti

(57) ABSTRACT

A nozzle for assemblies and gas turbines is provided. The nozzle exhibits destabilized flame holding characteristics, i.e., the nozzle is unable to stabilize flame up to an equivalence ratio of about 0.65. As a result, flame heat release is delayed resulting in lower peak flame temperatures and correspondingly lower NOx levels. Flame stabilization capability is retained for higher equivalence ratios to support operation of the combustor in other regions of the load range.

7 Claims, 14 Drawing Sheets

(56) References Cited

U.S. PATENT DOCUMENTS

| | | | | |
|---|---|---|---|---|
| 6,311,471 | B1 | 11/2001 | Waldherr et al. | |
| 6,311,473 | B1 | 11/2001 | Benjamin et al. | |
| 6,397,602 | B2 * | 6/2002 | Vandervort et al. | 60/737 |
| 6,598,383 | B1 | 7/2003 | Vandervort et al. | |
| 6,915,636 | B2 | 7/2005 | Stuttaford et al. | |
| 7,181,916 | B2 | 2/2007 | Ziminsky et al. | |
| 7,185,494 | B2 | 3/2007 | Ziminsky et al. | |
| 7,513,100 | B2 | 4/2009 | Motter et al. | |
| 7,546,735 | B2 | 6/2009 | Widener | |
| 8,172,568 | B2 | 5/2012 | Kashihara et al. | |
| 8,984,889 | B2 * | 3/2015 | Wilbraham | 60/748 |
| 2001/0004827 | A1 * | 6/2001 | Vandervort et al. | 60/39.55 |
| 2004/0000146 | A1 * | 1/2004 | Inoue et al. | 60/776 |
| 2005/0268617 | A1 * | 12/2005 | Amond et al. | 60/776 |
| 2009/0031728 | A1 | 2/2009 | Miura et al. | |
| 2009/0229269 | A1 | 9/2009 | Lacy et al. | |
| 2010/0005804 | A1 | 1/2010 | Chen et al. | |
| 2010/0031661 | A1 | 2/2010 | Varatharajan et al. | |

OTHER PUBLICATIONS

Haynes, "Emission Reduction using a Lifted Flame in a Lean Premixed Combustor", Proceedings of GT2006 ASME Turbo Expo 2006: Power for Land, Sea and Air, May 8-11, 2006, Barcelona Spain.

Vandervort, "9 ppm NOx/CO Combustion System for 'F' Class Industrial Gas Turbines", Journal of Engineering for Gas Turbines and Power, Apr. 2001, pp. 317-321, vol. 123.

Unofficial English Translation of Japanese Office Action issued in connection with corresponding JP Application No. 2011166337 on May 26, 2015.

Unofficial English translation of Office Action issued in connection with corresponding CN Application No. 201110224376.7 on Jun. 13, 2014.

* cited by examiner

FUEL NOZZLE AND ASSEMBLY AND GAS TURBINE COMPRISING THE SAME

BACKGROUND

The embodiments disclosed relate generally to gas and liquid fuel turbines, including both can-annular or annular combustion systems, and methods of operating such combustion systems.

Dry Low NOx technology is routinely applied for emissions control with gaseous fuel combustion in industrial gas turbines with can-annular combustion systems through utilization of premixing of fuel and air. The primary benefit of premixing is to provide a uniform rate of combustion resulting in relatively constant reaction zone temperatures. Through careful air management, these temperatures can be optimized to produce very low emissions of oxides of nitrogen (NOx), carbon monoxide (CO) and unburned hydrocarbons (UHC). Modulation of a center premix fuel nozzle can expand the range of operation by allowing the fuel-air ratio and corresponding reaction rates of the outer nozzles to remain relatively constant while varying the fuel input into the turbine.

Fuel staging is well-understood by those experienced in the art as a means of achieving higher turbine inlet temperatures with uniform heat release. Axially staged systems employ multiple planes of fuel injection along the combustor flow path. Utilization of axial fuel staging requires special design considerations to inject fuel into the high temperature products of combustion. The high temperature and pressure environment of the latter stages of an axially staged combustor have prevented development of robust designs suitable for commercial applications.

It would therefore be desirable to develop new gas turbines having a fuel system configuration and/or utilizes a method of staging fuel so that lower peak fuel temperatures are achieved. Such gas turbines would be expected to have correspondingly low NOx and CO emissions. The ability of a new gas turbine to exhibit of an increased range of operability within such "Emissions Compliant" regimes would provide further advantages.

BRIEF DESCRIPTION

A gas turbine fuel nozzle is provided. The fuel nozzle has a physical configuration so that the nozzle is unable to stabilize flame up to an equivalence ratio of about 0.65.

In another aspect, an assembly for a single stage gas turbine combustor is provided. The assembly comprises an array of outer nozzles arranged about a center axis, and a center nozzle located on said center axis, wherein said center nozzle has a physical configuration such that the center nozzle is unable to stabilize flame up to an equivalence ratio of about 0.65.

In another aspect, there is provided a gas turbine comprising a plurality of combustors. Each combustor has a plurality of outer fuel nozzles arranged about a longitudinal axis of the combustor, a center nozzle disposed substantially along said longitudinal axis, and a single combustion zone. The center nozzle is unable to stabilize flame up to an equivalence ratio of about 0.65.

BRIEF DESCRIPTION OF THE DRAWINGS

These and other features, aspects, and advantages of the present invention will become even better understood when the following detailed description is read with reference to the accompanying drawings in which like characters represent like parts throughout the drawings, wherein.

DETAILED DESCRIPTION

Figure 1:
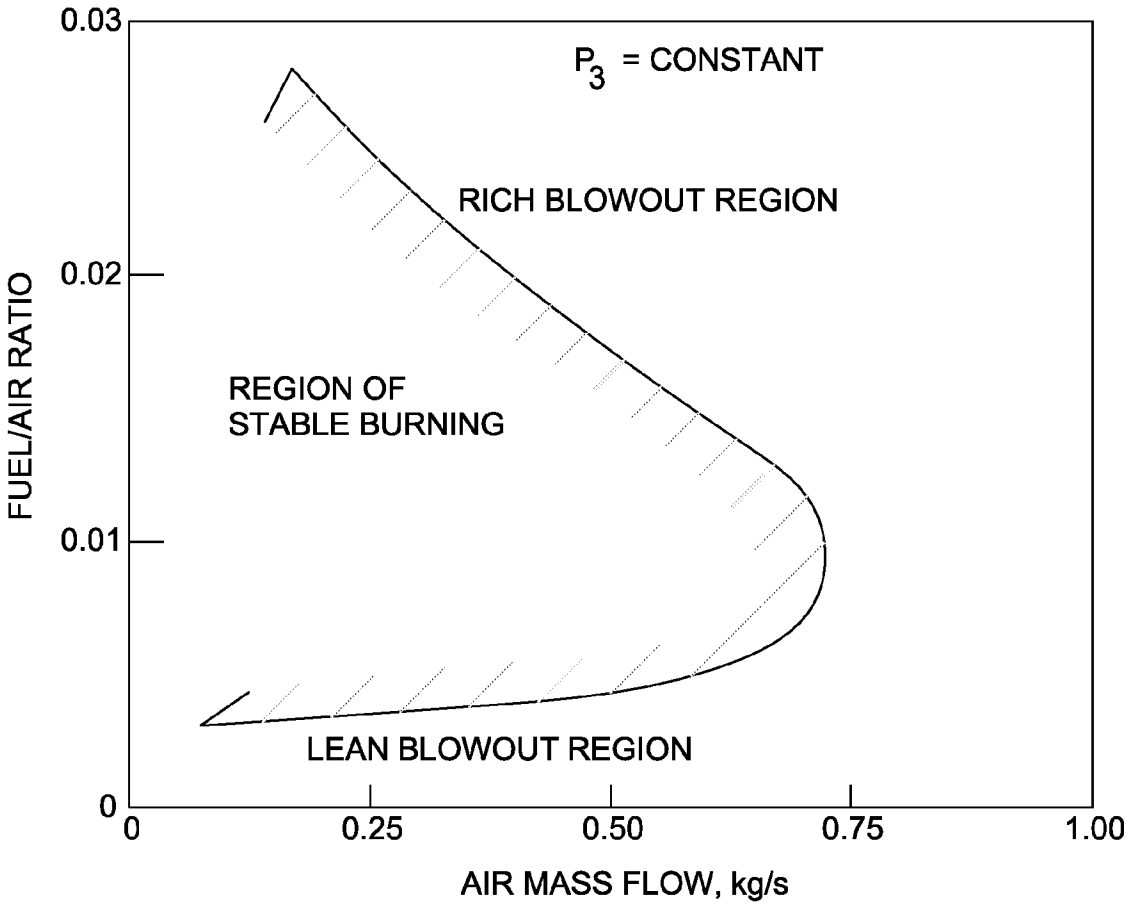
FIG. 1 (Prior Art)
FIG. 1 is a representation of combustor operability or flame stability for a gas turbine combustion system.

The above brief description sets forth features of the various embodiments of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several embodiments of the invention in detail, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The terms "first," "second," and the like, as used herein do not denote any order, quantity, or importance, but rather are used to distinguish one element from another. The terms "a" and "an" herein do not denote a limitation of quantity, but rather denote the presence of at least one of the referenced items. The modifier "about" used in connection with a quantity is inclusive of the stated value, and has the meaning dictated by context, (e.g., includes the degree of error associated with measurement of the particular quantity). The suffix "(s)" as used herein is intended to include both the singular and the plural of the term that it modifies, thereby including one or more of that term.

Reference throughout the specification to "one embodiment" or "an embodiment" means that a particular feature, structure, or characteristic described in connection with an embodiment is included in at least one embodiment. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Provided herein is a fuel nozzle, and assembly and gas turbine comprising the nozzle, that utilizes fuel staging to achieve very low emissions on gaseous fuel. Nozzles, assemblies and combustors incorporate physical configurations so that flame stabilization is avoided without utilizing down-stream fuel injection. The desired low emissions are thus provided.

FIG. 1 is a graphical depiction of flame stability for a conventional gas turbine combustion system. As shown, flame stability is a function of fuel/air ratio and air flow. There is a region of stable burning, the size of which potentially being impacted by several variables including fuel type. The nozzles, assemblies and combustors provided herein are physically configured so that the region of stable burning is decreased, and the region of flame stability is increased.

Avoidance of flame stabilization, in turn, allows unburned fuel to propagate downstream, beyond the primary reaction zones (FIG. 4, 43) of adjacent fuel nozzles. That is, a flame supported by the present nozzle will not burn right away, but will burn within the combustor zone of the assembly and/or combustor. The result is similar to that provided by axial fuel staging, without the conventional requirement for downstream fuel injection.

Figure 2:
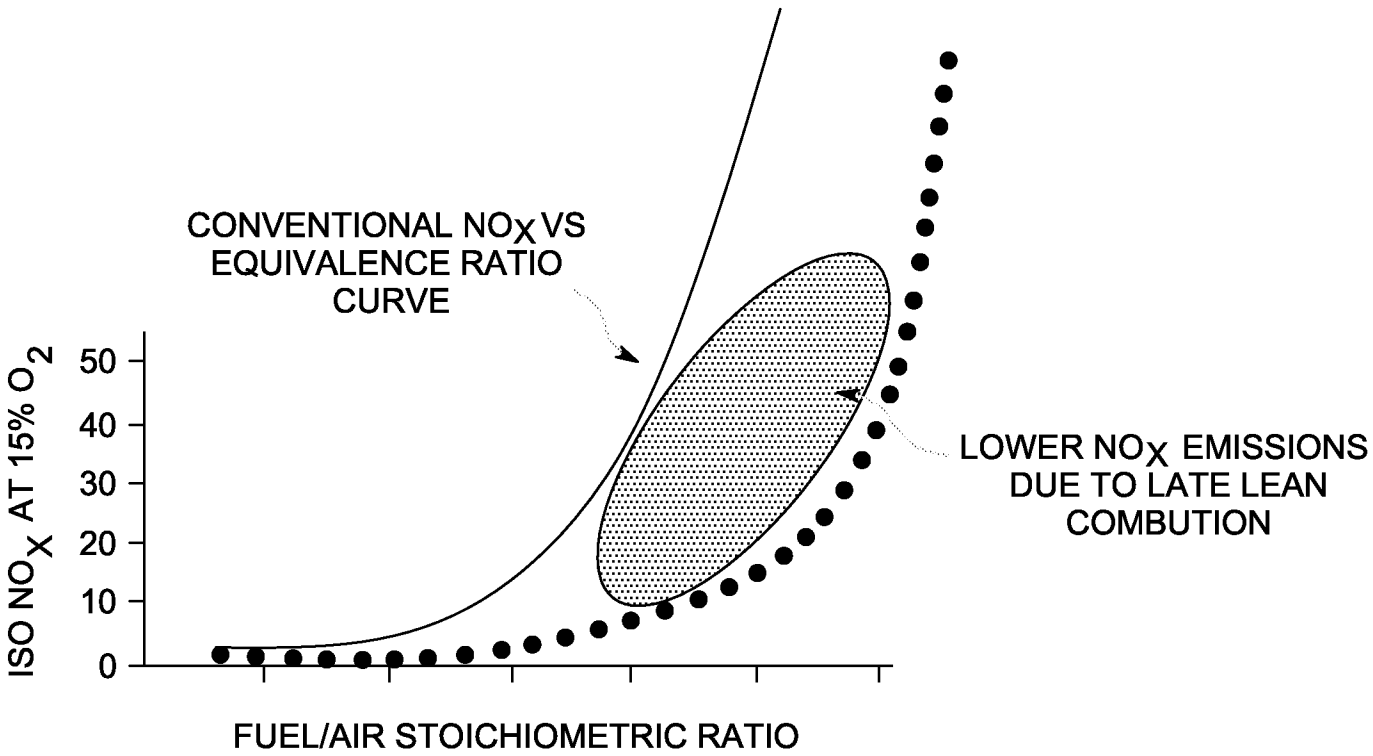
FIG. 2 is a graphical depiction of the fuel air stoichiometric ratio (x-axis) versus the NOx levels at 15% $O_2$ (y-axis) showing the benefit of late lean combustion.

The benefits of axial fuel staging, or late lean injection, on NOx emissions from a premixed flame are graphically depicted in FIG. 2. The conventional NOx versus fuel/air relationship is shown with the solid line, while the NOx versus fuel/air relationship that occurs in nozzles, assemblies and combustors employing axial fuel staging is indicated by the dashed line (also referred to from time to time by those of ordinary skill in the art as late lean fuel injection). As shown, an enhanced area of operating fuel/air ratios is provided, that is yet capable of operating within the desired NOx emissions. Late introduction of a portion of the fuel enables extension of the overall flame zone, which in turn results in a lowering of peak temperatures and a reduction in NOx emissions. However, it has not yet been possible to demonstrate a practical means of placing the late or down-stream fuel nozzles in the path of the high temperature combustion gas. In the present nozzles, assemblies and combustors, this enhanced operating area is provided by the physical configuration of the nozzle so that late lean injection can be avoided, while yet the same effect can be seen. Even though the present nozzle is capable of providing the benefits of late lean injection, without requiring such a configuration, the nozzle is yet also capable of use at high fuel/air ratios, i.e., of greater than 0.65 for operation in low-power modes.

Figure 3:
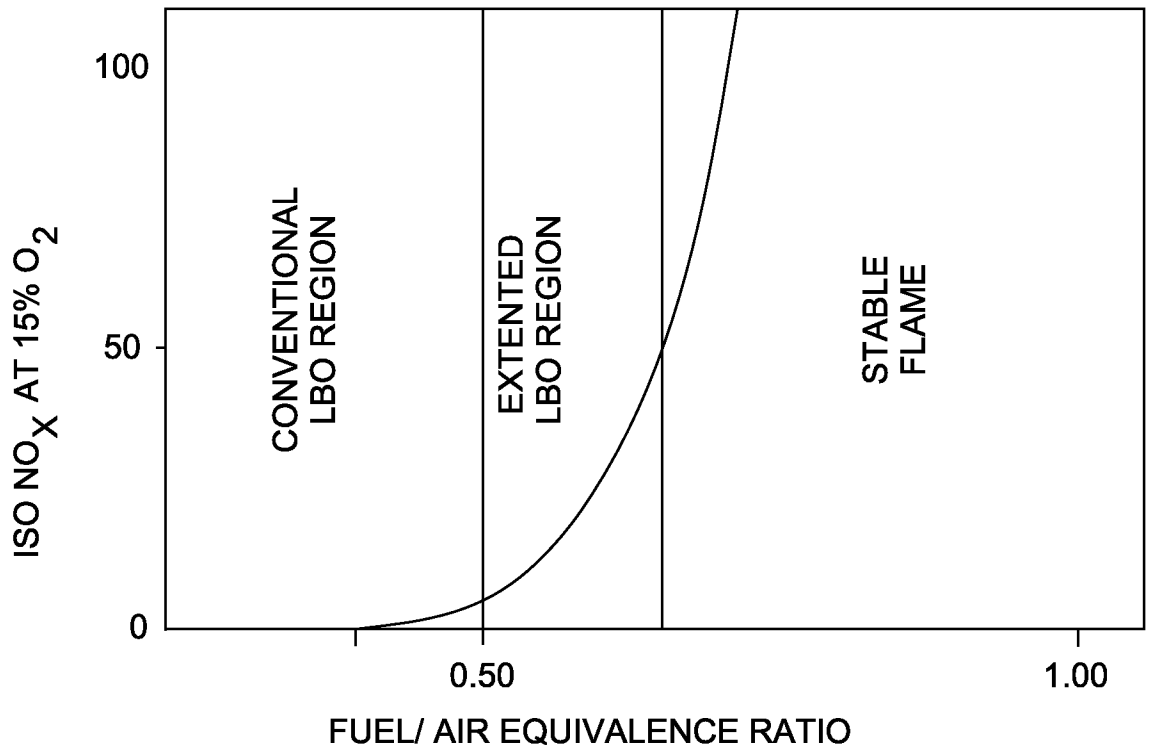
FIG. 3 shows the regions of flame stability for a premixed combustion system, region "1" is the range where conventional fuel nozzles are unable to stabilize a flame (conventional lean blow out), region "2" is the range where this improved fuel nozzle is unable to stabilize a flame (extended lean blow out), and region "3" is a region where all fuel nozzles can stabilize flame.

FIG. 3 is a graphical depiction of NOx emissions versus fuel air ratio. The right-hand region of the graph shows the normal range of lean blow out for a premixed fuel nozzle. The center region shows a range of extended lean blow out that can be achieved using embodiments of the present center fuel nozzle. The left region shows the area where flame stabilization could not occur for the center fuel nozzle due to insufficient fuel flow or excessively low fuel-air ratio.

And so, provided herein is a nozzle that may desirably be part of a combustor assembly, arranged in annular or can-annular configuration on an industrial gas turbine. The present nozzles, assemblies and combustors are advantageously employed at low to moderate fuel/air ratios, e.g., at fuel/air ratios of less than 0.65, as may typically be utilized in high-power modes.

Figure 4:
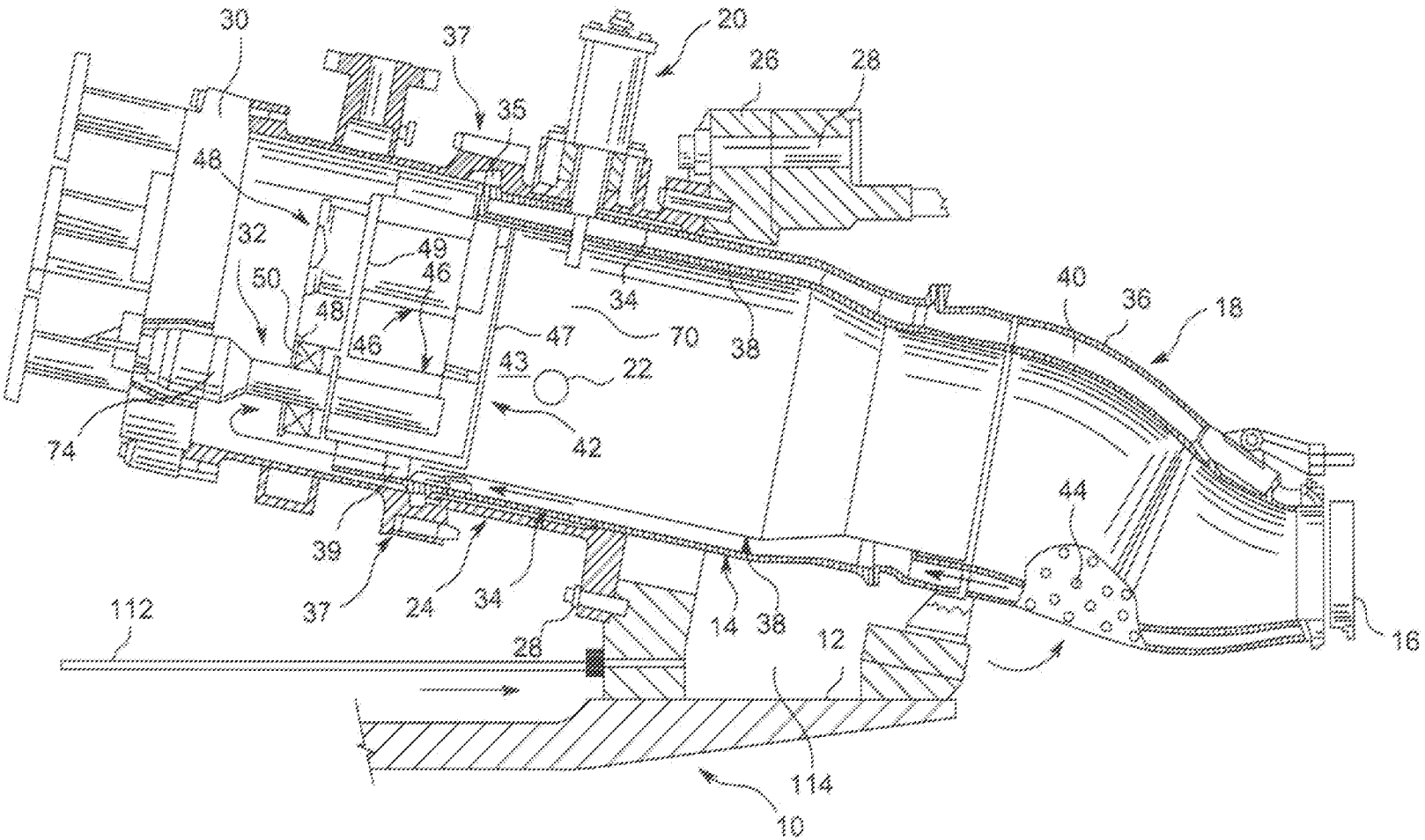
FIG. 4 is a schematic cross-sectional view of a can-annular combustor of a turbine in accordance with one embodiment.

FIG. 4 is a schematic cross-sectional view through one of the combustors of a turbine comprising a can-annular combustor configuration. Gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then flows in reverse to the combustor 14 where it is used to cool combustor 14 and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine. Ignition is achieved in the various combustors 14 by means of spark plug 20 in conjunction with cross fire tubes 22 in the usual manner.

Each combustor 14 includes a substantially cylindrical combustor casing 24 which is secured at an open forward end to the turbine casing 26 by means of bolts 28. The rearward or proximal end of the combustion casing is closed by an end cover assembly 30 which includes supply tubes, manifolds and associated valves for feeding gaseous fuel, liquid fuel, air and water to the combustor 14 as described in greater detail below. The end cover assembly 30 receives a plurality (for example, three to six) "outer" fuel nozzle assemblies 32 (one shown) arranged in a circular array about a longitudinal axis of combustor 14, and one center nozzle 33.

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 wherein fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42, which is, in turn, supported within the combustor casing by a plurality of struts 39 and an associated mounting assembly. Outer wall 36 of the transition duct 18 and that portion of flow sleeve 34 extending forward of the location where the combustor casing 24 is bolted to the turbine case are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor (as indicated by the flow arrows shown in FIG. 1).

The combustion liner cap assembly 42 supports a plurality of premix tubes 46, one for each of "outer" fuel nozzle assemblies 32 and center nozzle 33. More specifically, each premix tube 46 is supported within the combustion liner cap assembly 42 at its forward and rearward ends by front and rear plates 47 and 49 respectively, each provided with openings aligned with the open-ended premix tubes 46. The front plate 47 (an impingement plate provided with an array of cooling apertures) may be shielded from the thermal radiation of the combustor flame by shield plates (not shown).

The rear plate 49 mounts on a plurality of rearwardly extending floating collars 48 (one for each premix tube 46, arranged in substantial alignment with the openings in the rear plate), each of which supports an air swirler 50 in surrounding relation to a radially outermost wall of the respective nozzle assembly. The arrangement is such that air flowing in the annular space between the liner 38 and flow sleeve 34 is forced to again reverse direction in the rearward end of the combustor (between the end cover assembly 30 and sleeve aperture 44) and to flow through the swirlers 50 and premix tubes 46. The construction details of the combustion liner cap assembly 42, the manner in which the liner cap assembly is supported within the combustion casing, and the manner in which the premix tubes 46 are supported in the liner cap assembly is the subject of U.S. Pat. No. 5,259,184, hereby incorporated herein by reference in its entirety.

Figure 5:
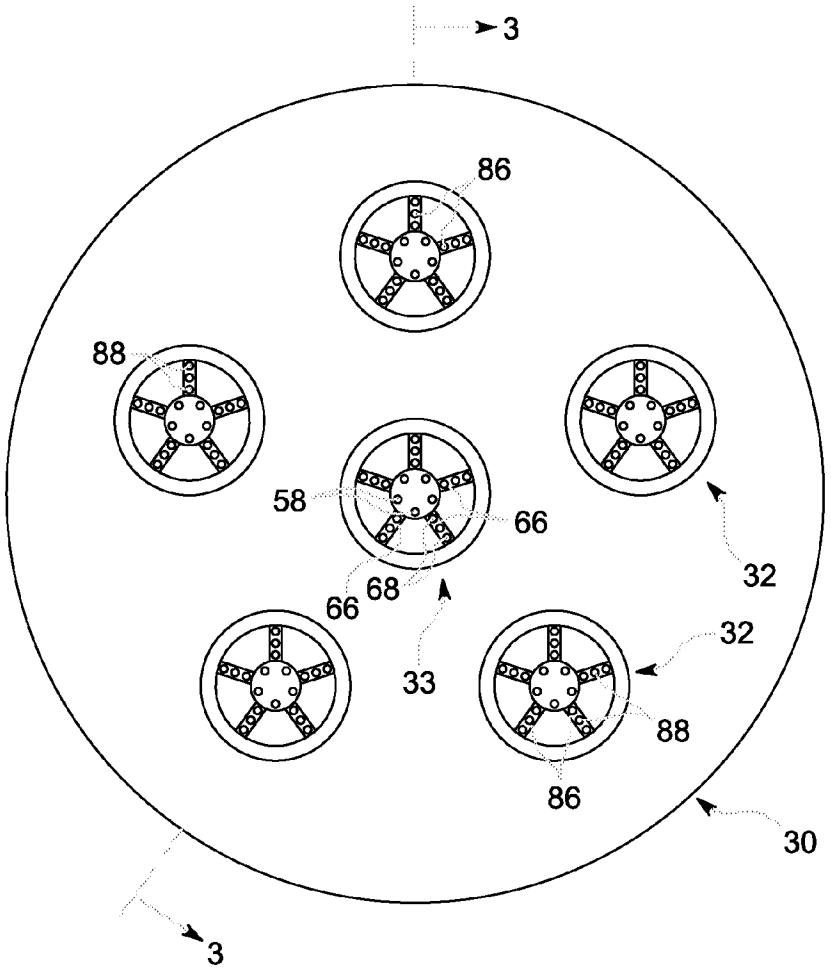
FIG. 5 is a schematic front end view of an end cover and fuel nozzle assembly in accordance with one embodiment.

FIG. 5 schematically shows a front end view and fuel nozzle assembly of one embodiment of an endcover arrangement of the can-annular combustor shown in FIG. 4. As noted above, outer fuel nozzle assemblies 32 and one center nozzle 33 are attached to endcover 30. The endcover 30 comprises internal passages which supply the gaseous and liquid fuel, water, and atomizing air to the nozzles as detailed below. Piping and tubing for supply of the various fluids are, in turn, connected to the outer surface of the endcover assembly.

Outer fuel nozzle assemblies 32 and center nozzle 33 may conventionally be configured to supply premix gaseous fuel, liquid fuel, water injection, atomizing air and/or diffusion fuel. In some embodiments, outer fuel nozzle assemblies 32 and center nozzle 33 are configured to provide premixed gaseous fuel.

Figure 6:
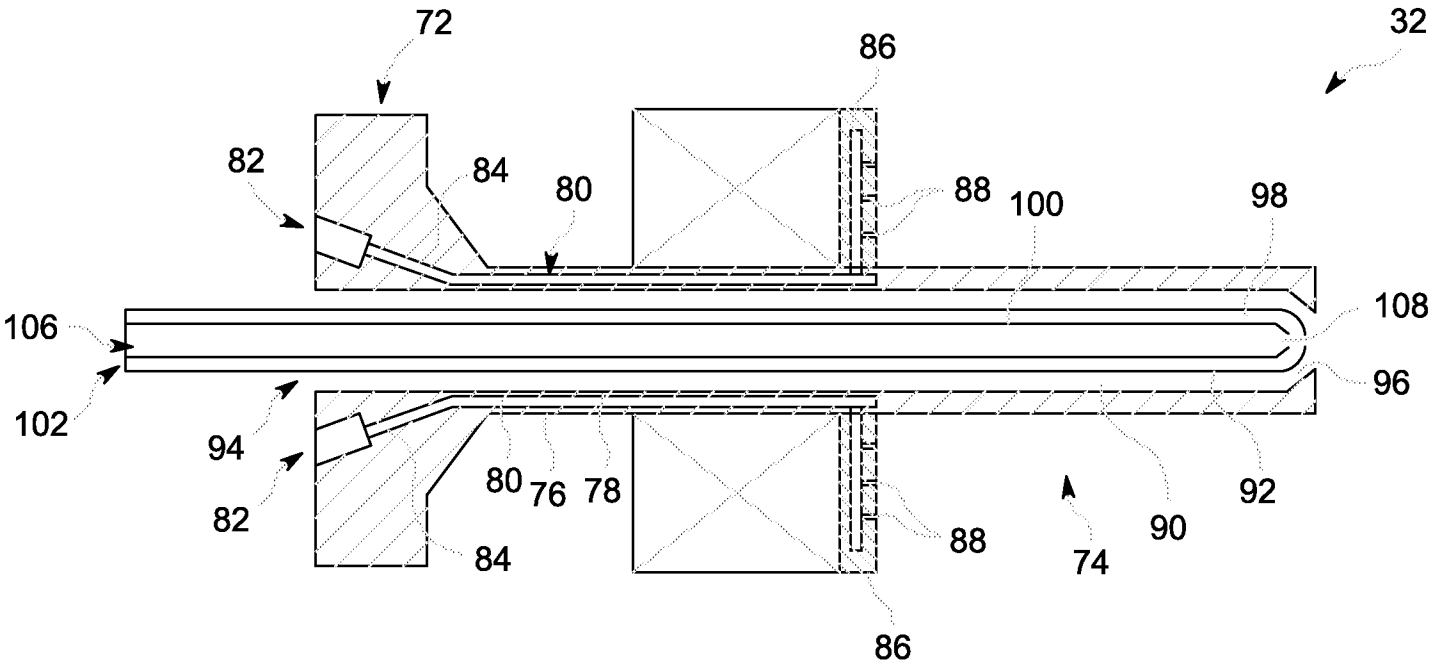
FIG. 6 is a schematic cross-sectional view of an outer fuel nozzle in accordance with some embodiments.

Referring to FIG. 6, each outer fuel nozzle assembly 32 includes a proximal end or rearward supply section 72, with inlets for receiving liquid fuel, water injection, atomizing air, and premixed gas fuel, and with suitable connecting passages for supplying each of the above-mentioned fluids. As mentioned above, outer fuel nozzle assemblies 32 are each configured to receive premixed gaseous fuel, and to supply it to a respective passage in a forward or distal delivery section 74 of the fuel nozzle assembly. Outer fuel nozzle assemblies may be configured so as to be substantially parallel to the longitudinal axis (axis of symmetry) of center fuel nozzle assembly 33, or may be tilted outward relative to this axis so that their flames are angled toward the wall of the liner. Such a configuration enables the center nozzle fuel to progress further downstream before igniting. Although the particular angle is not critical so long as the foregoing objective is achieved, the tilt angle may be limited by the wall of the liner. Useful tilt angles, relative to the longitudinal axis of center fuel nozzle 33 are expected to range from about 1° to about 7 degrees.

In the embodiment shown, the forward delivery section of the outer fuel nozzle assembly 32 is comprised of a series of concentric tubes. Tubes 76 and 78 define premix gas passage(s) 80 which receive(s) premix gas fuel from premix gas fuel inlet(s) 82 in rearward supply section 72 via conduit 84. The premix gas passages 80 communicate with a plurality of radial fuel injectors 86, each of which is provided with a plurality of fuel injection ports or holes 88 for discharging gas fuel into the premix zone located within the premix tube 46. The injected premix fuel mixes with air reverse flowed from compressor 12.

A second passage 90 is defined between concentric tubes 78 and 92 and is used to supply atomizing air from atomizing air inlet 94 to the burning zone 70 of the combustor 14 via orifice 96. A third passage 98 is defined between concentric tubes 92 and 100 and is used to supply water from water inlet 102 to the burning zone 70 to effect NOx reductions in the manner understood by those skilled in the art.

Tube 100, the innermost of the series of concentric tubes forming the outer nozzles 32, itself forms a central passage via liquid fuel inlet 106. The liquid fuel exits the nozzle by means of a discharge orifice 108 in the center of outer nozzle assembly 32. Thus, all outer nozzles 32 and center gas nozzle 33 provide premix gaseous fuel. The center nozzle 33, but not the outer nozzles 32 provides a passive air purge, and each of the outer nozzles 32, but not the center nozzle 33, is configured for delivering liquid fuel, water for emissions abatement, and atomizing air. A number of quaternary pegs (not shown) are located circumferentially around the forward combustion casing distributing fuel through 8 holes per peg.

Center fuel nozzle 33 is provided with a physical configuration that minimizes turbulence and flow recirculation such that flame stability is poor. Center nozzle 33 is thus capable of providing such flame destabilization at equivalence ratios lower than about 0.65. Non-limiting examples of physical configurations that provide such ability to center nozzle 33 include one or more aerodynamic features, such as, e.g., a streamlined nozzle tip, nozzle tip air purge, streamlined swirler, dual swirler, dual counter-rotating swirler, combined swirler and nozzle, inlet flow conditioner, burner tube exit bell-mouth and/or diverging burner tube wall.

For example, in some embodiments, center fuel nozzle 33 may be provided with streamlined tip, alone or in combination with a nozzle tip air purge that both cools the aft region of the nozzle and quenches the remaining recirculation zones. As a result, the flame has difficulty attaching in this region, i.e., center fuel nozzle 33 exhibits reduced flame stability as compared to a conventional center fuel nozzle. And so, premixed fuel dispensed from center fuel nozzle 33 will travel, or convect, downstream, prior to igniting. The result is similar to the affect of axial fuel staging but does advantageously not require downstream fuel injection.

In some embodiments, center fuel nozzle 33 may comprise any number of swirlers, in any configuration. For example, center nozzle 33 may be provided with a streamlined swirler, dual swirler, dual counter-rotating swirler, a swirler combined with a nozzle or fuel peg, etc. Any such swirlers may provide for rotating or counter-rotating flow of fluids dispensed there, and may act to destabilize the flame provided at the tip of center fuel nozzle 33. Or, center fuel nozzle 33 may be disposed within a burner tube having a "bell shaped" exit. Inlet flow conditioners may also be utilized to achieve the desired flame destabilization, or, the same may be provided by a different outer nozzle configuration. Any of these may be used alone or in any combination. Several embodiments of such configurations of center fuel nozzle 33 are shown in FIGS. 7-13.

Figure 7:
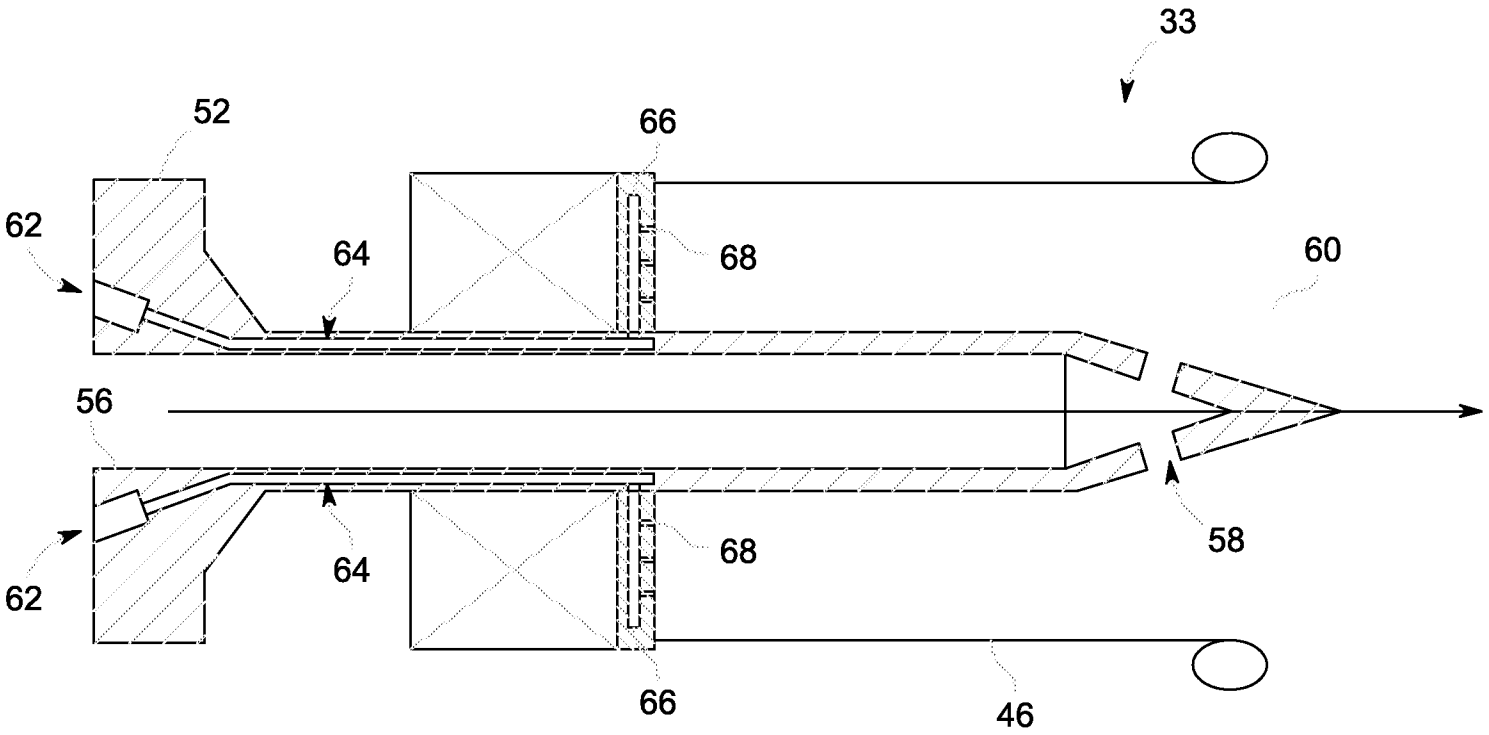
FIG. 7 is a schematic cross-sectional view of a center fuel nozzle in accordance with one embodiment.

One embodiment of center fuel nozzle 33 is shown in FIG. 7. As shown, center fuel nozzle assembly 33 includes a proximal end or rearward supply section 52 with passage 56 that extends through center nozzle assembly 33 and for receiving a passive air purge. Inlet 54 is operatively disposed to receive air via extraction port 112 from compressor discharge region 114, both of which are shown in FIG. 4. Central passage 56 passively supplies air to burning zone 70 of combustor 14 (FIG. 4) via nozzle tip air purge orifices 58 defined at the forwardmost end 60 of the center fuel nozzle assembly 33. In the context of turbine 10, the distal or forward discharge end 60 of center fuel nozzle assembly 33 is located within premix tube 46, and close to the distal or forward end thereof.

Inlets 62 are also defined in the rearward supply section 52 of the nozzle for premix gas fuel. The premix gas passage(s) 64 communicate with a plurality of radial fuel injectors 66, each of which is provided with a plurality of fuel injection ports or holes 68 for discharging premix gas fuel into a premix zone located within premix tube 46.

Figure 8:
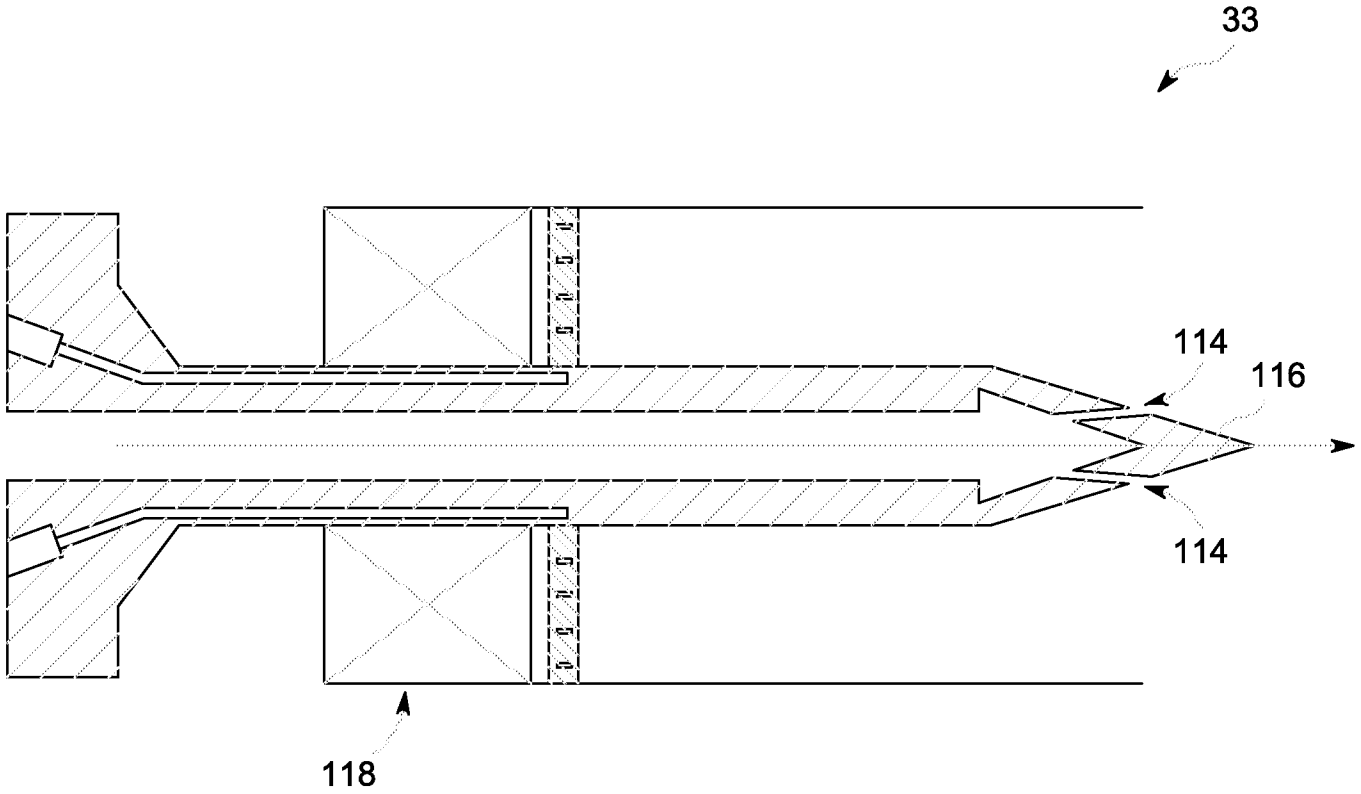
FIG. 8 is a schematic cross-sectional view of a center fuel nozzle in accordance with one embodiment.
Figure 9:
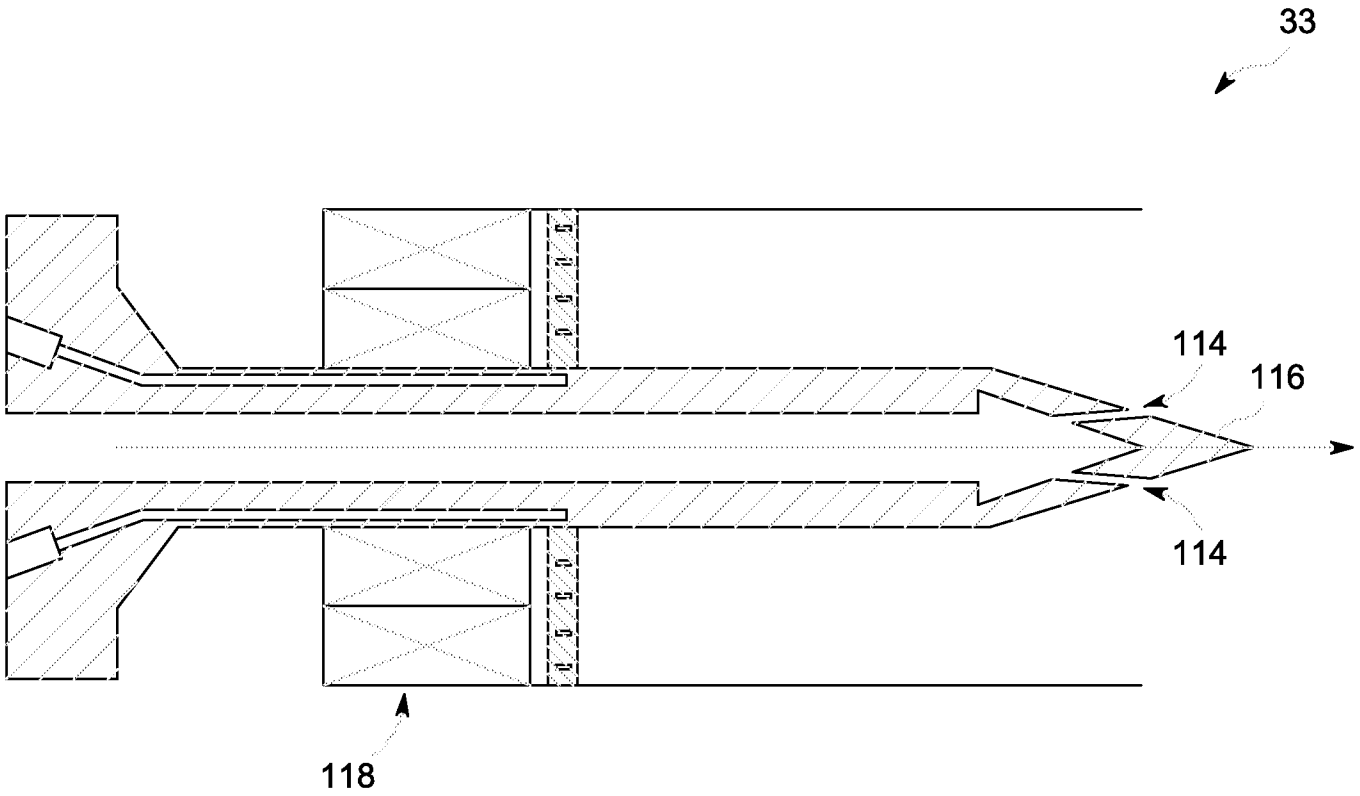
FIG. 9 is a schematic cross-sectional view of a center fuel nozzle in accordance with one embodiment.

FIGS. 8 and 9 show two additional embodiments of center fuel nozzle 33. More particularly, in the embodiments shown in FIGS. 8 and 9, center fuel nozzle 33 is provided with a streamlined nozzle tip 116, as well as nozzle tip air purge ports 114 to cool the tip of center fuel nozzle 33, and to prevent attachment of a flame thereto. The embodiments shown in FIGS. 8 and 9 also employ swirlers in order to destabilize the flame, the embodiment of FIG. 8 showing single streamlined annular swirlers 118, and the embodiment of FIG. 9 utilizing dual annular swirlers 118.

Figure 10:
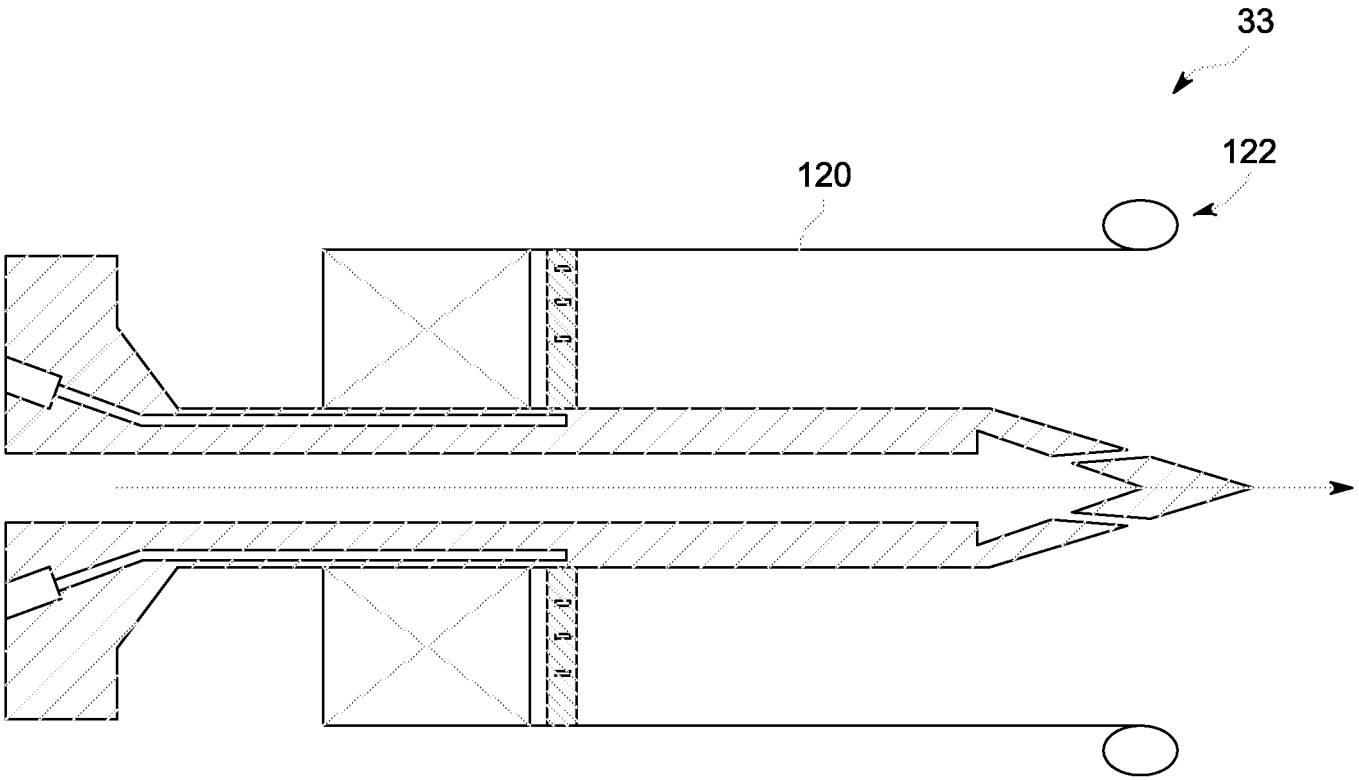
FIG. 10 is a schematic cross-sectional view of a center fuel nozzle in accordance with one embodiment.
Figure 11:
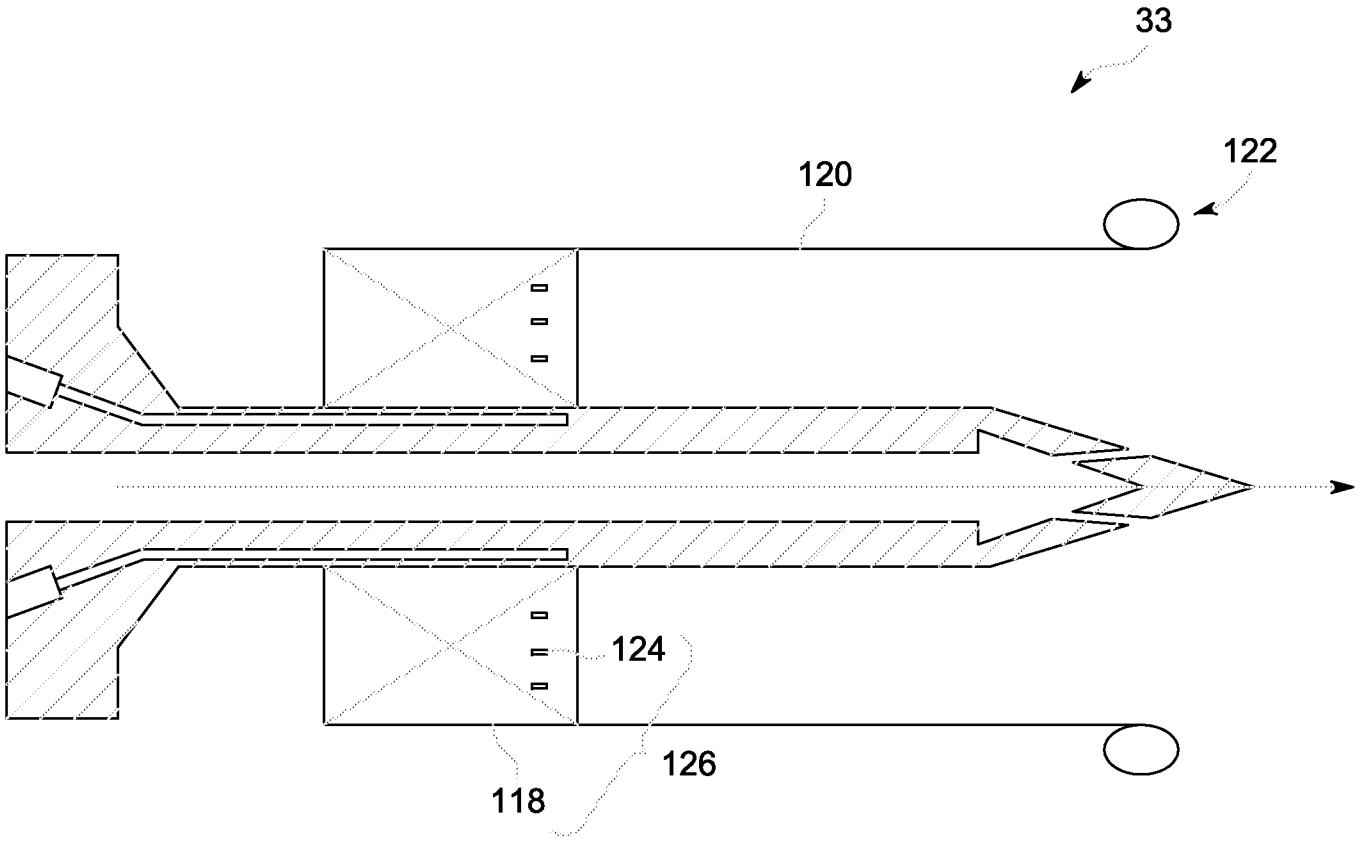
FIG. 11 is a schematic cross-sectional view of a center fuel nozzle in accordance with one embodiment.

FIG. 10 shows an additional embodiment of center fuel nozzle 33, wherein the burner tube 120 is provided with bell-mouth exit 122. While not wishing to be bound by any theory, it is believed that providing burner tube 120 with such an exit can reduce turbulence and flow recirculation that, in turn, can enhance flame stability. FIG. 11 shows an embodiment of center fuel nozzle 33 wherein swirler 118 and fuel injection pegs 124 are combined to form "swozzle" 126. This embodiment thus advantageously provides a more aerodynamic configuration with less opportunity for development of turbulence, vortex generation, or recirculation. FIG. 11 also shows bell mouth exit 122 on burner tube 120, although as mentioned above, this is not necessarily the case, and any single configuration that allows center fuel nozzle 33 to provide a destabilized flame at fuel/air ratios of lower than 0.65 may be utilized alone, or in combination with one or more of any other such configuration.

Figure 12:
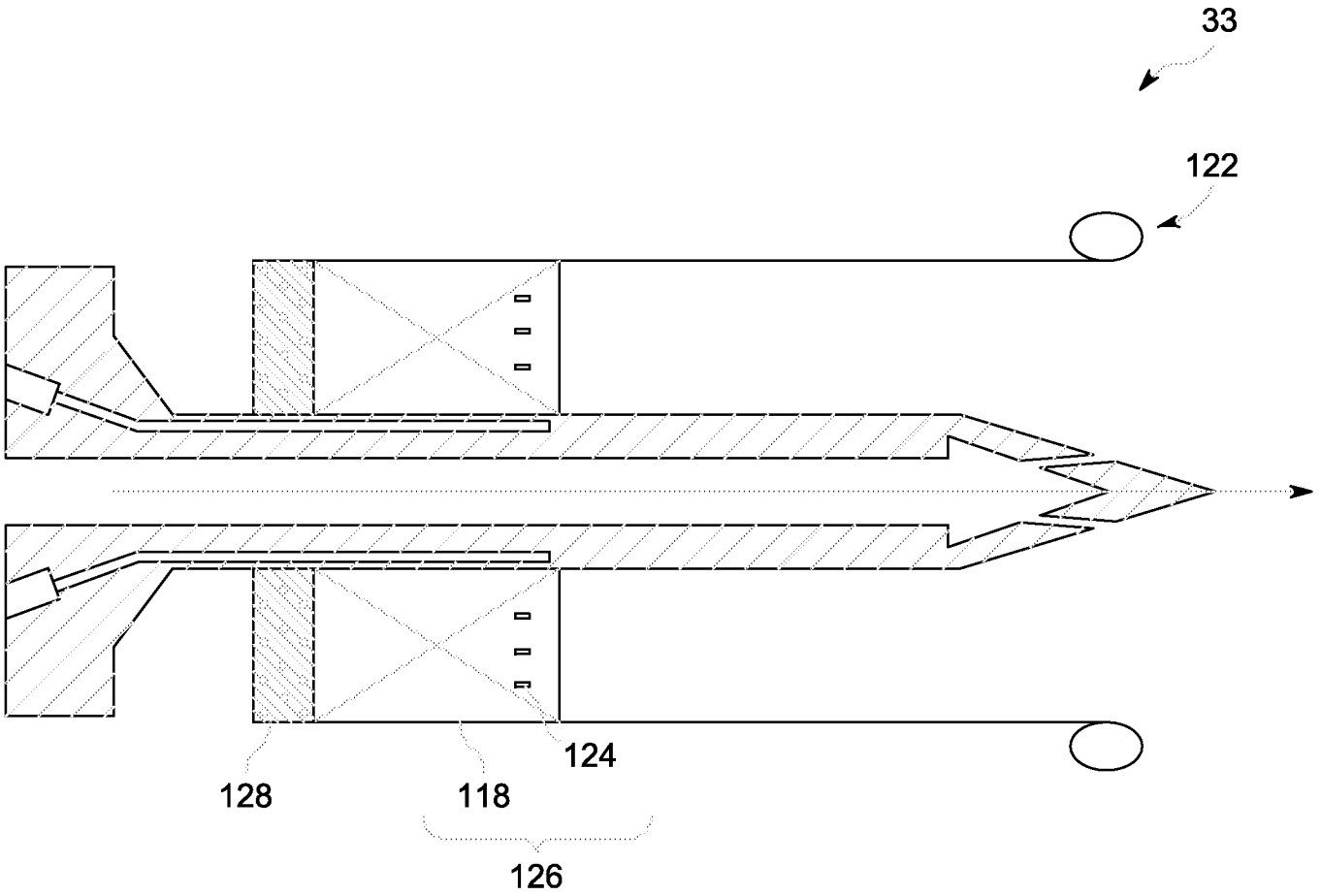
FIG. 12 is a schematic cross-sectional view of a center fuel nozzle in accordance with one embodiment.
Figure 13:
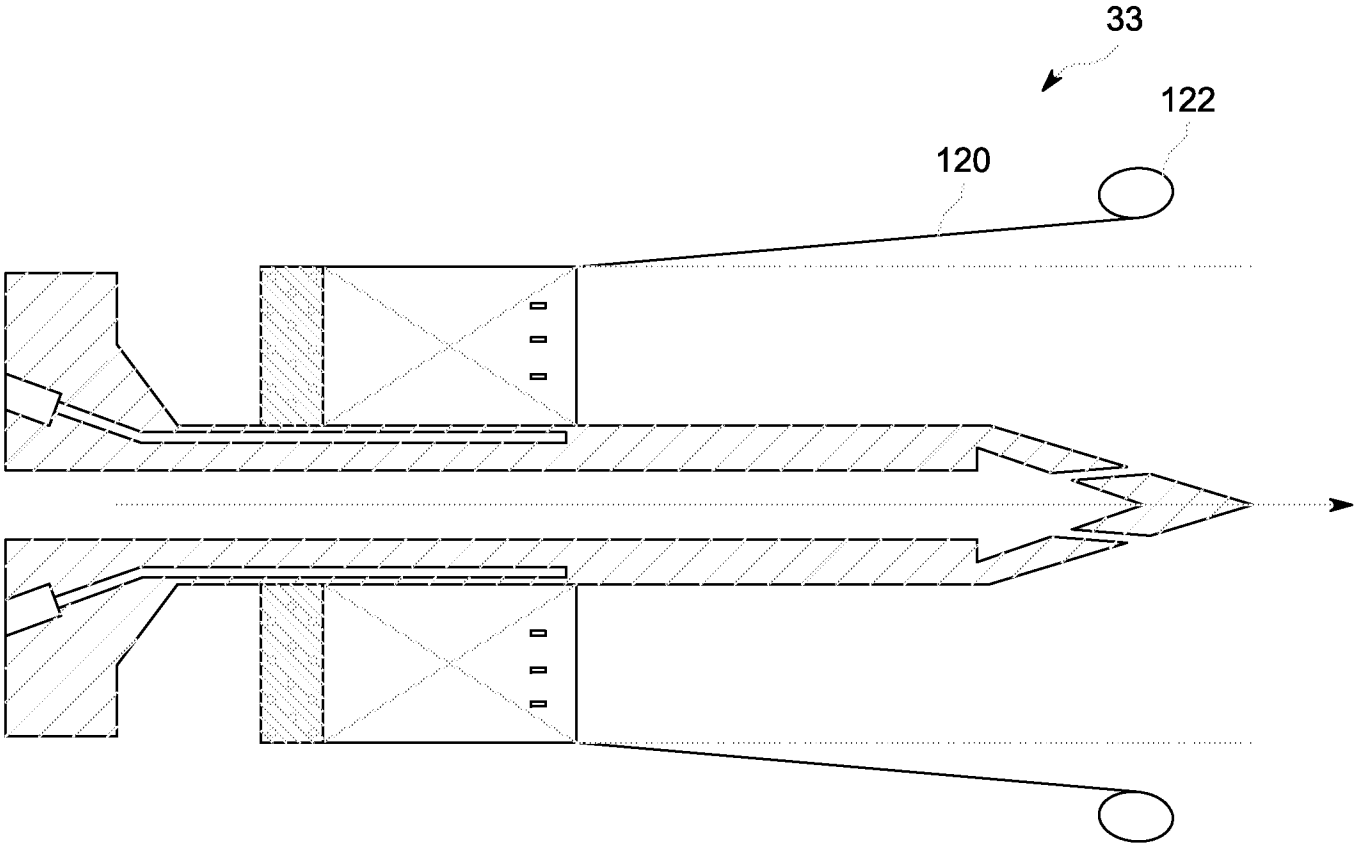
FIG. 13 is a schematic cross-sectional view of a center fuel nozzle in accordance with one embodiment.

FIG. 12 shows a further embodiment of center fuel nozzle 33, wherein inlet flow conditioner 128 is provided proximal to combined swirler 118 and fuel pegs 124, or "swozzle" 126. Inlet flow conditioners 128 can be considered analogous to flow straighteners and serve to provide a uniform and one-dimensional inlet flow to the swirler or swozzle. The benefit is that less turbulence, vortex generation, or recirculation occurs. FIG. 13 shows an embodiment of center fuel nozzle 33 wherein burner tube 120 is provided with bellmouth 122, wherein bellmouth 122 is divergent from a plane parallel to the longitudinal axis of center fuel nozzle 33.

Figure 14B:
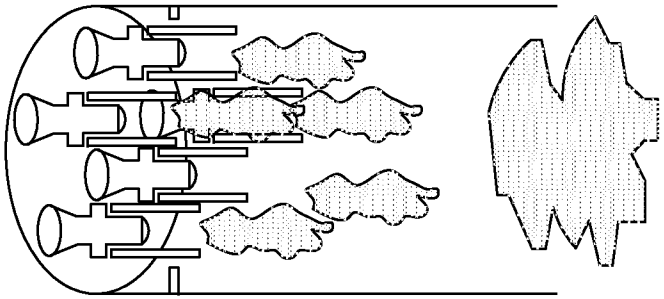
FIG. 14B is a representation of the flame shapes for a can-annular combustor according to one embodiment.
Figure 14A:
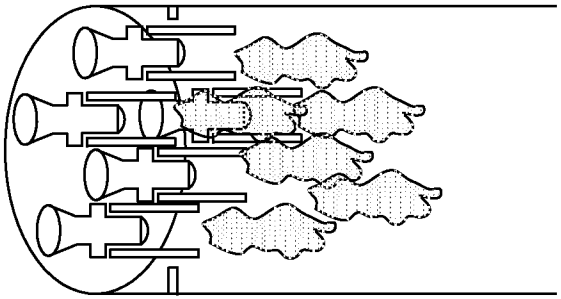
FIG. 14A is a representation of the flame shapes for a conventional can-annular combustor.
Figure 14C:
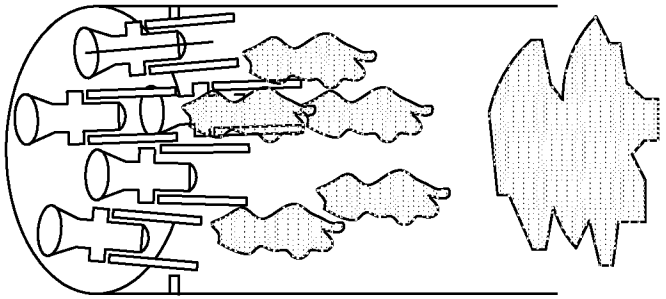
FIG. 14C is a representation of the flame shapes for a can-annular combustor according to one embodiment.

Flame shapes for conventional nozzle combustion systems as compared to the inventive combustion systems are shown in FIGS. 14A-14C. More particularly, a conventional passive late lean combustion system is shown in FIG. 14A, and shows the flame stabilized on all fuel injectors. In contrast, an inventive combustion system comprising embodiments of the present center nozzle is shown in FIG. 14B, and shows a destabilized flame on the center nozzle, that only ignites farther downstream from the center nozzle. FIG. 14C shows another embodiment, wherein the outer fuel nozzles are tilted outward, resulting in the convection of unburned fuel even farther downstream prior to ignition.

The turbine operates on gaseous fuel in a number of modes. The first mode supplies premix gas fuel to two of outer nozzles 32 and to center nozzle 33, for acceleration of the turbine. From ignition and completion of cross-firing thereof and until approximately 95% speed, the flow of premix fuel to center nozzle 33 is turned off, and that percentage of fuel is redirected to two of outer fuel nozzles 32. From approximately 95% speed and very low load operation, the flow of premix fuel to outer fuel nozzles 32 is turned off, and that percentage of fuel is to premix gaseous fuel is supplied to center nozzle 33. As the unit load is further raised, premix gaseous fuel is supplied to two of outer fuel nozzles 32 and center fuel nozzle 33. At approximately 20% load, flow is diverted from two of outer fuel nozzles 32 to three of outer fuel nozzles 32, while flow is maintained through center fuel nozzle 33. At approximately 30% load, the flow of premix gaseous fuel through center fuel nozzle 33 is turned off and that percentage of the premix gas fuel is delivered through the two of outer fuel nozzles 32 so that all outer fuel nozzles 32 are delivering premix gaseous fuel. For a brief period of time, fuel is supplied exclusively to the outer premixed and quaternary nozzles. As approximately 30% load, the center nozzle 33 is turned on again to deliver premix gaseous fuel through the premix gas fuel passages (64). This mode is applied with controlled fuel percentages to the premix gas nozzles up to 100% of the rated load. In order to operate in modes 1, 3 and 4, the center fuel nozzle generally must be capable of stabilizing flame at equivalence ratios of greater than 0.65.

Those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A gas turbine comprising a single stage of fuel injection, the gas turbine comprising:

a plurality of combustors located about the periphery of the gas turbine in the single stage, each combustor comprising:

a plurality of outer fuel nozzles arranged about a longitudinal axis of the combustor and configured to provide fuel for ignition in a primary reaction zone of the gas turbine;

a center nozzle disposed substantially along the longitudinal axis and configured to provide fuel propagatable downstream from the primary reaction zone prior to ignition in a second zone beyond the primary reaction zone.

2. The gas turbine of claim 1, wherein each of the plurality of outer fuel nozzles is tilted outward relative to the longitudinal axis toward a wall of a liner of a respective combustor.

3. The gas turbine of claim 1, wherein the center fuel nozzle is configured for minimizing turbulence and flow recirculation of the fuel provided from the center nozzle.

4. gas turbine of claim 1, wherein the center fuel nozzle comprises at least one aerodynamic feature for minimizing turbulence and flow recirculation of the fuel provided from the center nozzle.

5. The gas turbine of claim 4, wherein the at least one aerodynamic feature comprises at least one of a streamlined nozzle tip, nozzle tip air purge, streamlined swirler, dual swirler, dual counter-rotating swirler, combined swirler and nozzle, inlet flow conditioner, burner tube exit bell-mouth and/or diverging burner tube wall.

6. The gas turbine of claim 1, wherein the center fuel nozzle comprises a rearward supply section, a forward discharge end, and a central passage extending from the rearward supply section to the forward discharge end, wherein the forward discharge end comprises nozzle tip air purge orifices for passively supplying air from the central passage.

7. The gas turbine of claim 6, wherein the center fuel nozzle further comprises a premix tube surrounding at least a portion of the center fuel nozzle, and wherein the rearward supply section comprises inlets, premix gas passages for receiving premix fuel through the inlets, and radial fuel injectors for discharging the premix gas fuel into a premix zone of the premix tube.

* * * * *